United States Patent [19]

Shead

[11] 3,997,074

[45] Dec. 14, 1976

[54] CRATE

[75] Inventor: Terence H. C. Shead, Chorley Wood, England

[73] Assignee: Worldwide Plastics Development Limited, Wolverhampton, England

[22] Filed: Feb. 24, 1975

[21] Appl. No.: 552,666

[30] Foreign Application Priority Data

Mar. 13, 1974 United Kingdom ..... 11259/74

[52] U.S. Cl. ..... 220/71; 220/21; 220/73

[51] Int. Cl.[2] ..... B65D 1/24; B65D 1/48

[58] Field of Search ..... 220/21, 71, 73, 84, 220/DIG. 15; 206/2; 229/49; 217/70

[56] References Cited

UNITED STATES PATENTS

| | | | |
|---|---|---|---|
| 1,108,289 | 8/1914 | Weiss | 229/49 X |
| 2,182,932 | 12/1939 | Sanford | 229/49 X |
| 2,675,156 | 4/1954 | Anderson, Jr. | 229/49 X |
| 2,758,742 | 8/1956 | Farrell | 220/DIG. 15 |
| 2,863,596 | 12/1958 | Harrison | 229/49 X |
| 3,327,896 | 6/1967 | Asenbauer | 220/71 X |
| 3,390,808 | 7/1968 | Rehrig et al. | 220/73 |

FOREIGN PATENTS OR APPLICATIONS

| | | | |
|---|---|---|---|
| 432,948 | 8/1935 | United Kingdom | 220/71 |

*Primary Examiner*—William Price
*Assistant Examiner*—Stephen Marcus
*Attorney, Agent, or Firm*—Kane, Dalsimer, Kane, Sullivan & Kurucz

[57] ABSTRACT

The invention relates to an open-topped rectangular crate formed from a synthetic plastic material internally reinforced with a steel reinforcement. The reinforcement is continuous and extends substantially along the upper edges of two opposite side walls of the crate, down adjacent to the four vertical corner edges of said crate and along the bottom edges of the other two opposite side walls of the crate.

3 Claims, 2 Drawing Figures

CRATE

The invention is concerned with a rectangular open-topped crate for holding, for example, wine or milk bottles.

It is well known to manufacture such crates from wood or metal, but these materials deteriorate after a time in use, leading to deformation of the crate or splintering or surface corrosion which thus make the crate unpleasant or even dangerous to use. As a result, more recently, plastic materials have been used in the construction of crates, the necessary rigidity being provided by complex rib and web configurations produced during the molding process, or by the insertion of metal reinforcing elements. Where the rigidity is produced by plastic rib and web configurations the mould tooling has necessarily been correspondingly complex and expensive, and even so the rigidity of the crates has left something to be desired when the crates have to be stacked. This is particularly so if the crates have to be stacked on their fronts with their nominal open tops exposed at one side of the stack for optional removal of the bottles from any crate in the stack.

In accordance with the present invention an open-topped rectangular crate is formed from a synthetic plastics material internally reinforced with a continuous length of reinforcement, the reinforcement extending substantially along the upper edges of two opposite side walls of the crate, down adjacent to the four vertical corner edges of the crate, and along the bottom edges of the other two opposite side walls of the crate. This configuration of a reinforcement, which may be for example steel rod, has a number of important advantages. Firstly, the reinforcement armature may be bent from a simple length or loop of material. The configuration is also economical in the use of the reinforcement material whilst providing the reinforcement in the most useful places. In this respect the reinforcements extending down the vertical corner edges of the crate act as struts when the crates are stacked upright on top of one another. The reinforcement across the bottom edges of two opposite side walls of the crate act as struts to reinforce the crates when they are stacked on one of their other sides on top of one another. The reinforcement along the upper edges of two opposite sides also strengthens the crate for lifting, if handles or handle openings are formed in the side walls below the reinforcement along their upper edges.

Since the rigidity of the crate in three dimensions is provided by the internal reinforcement, the plastic walls of the crate may be comparatively smooth except for any profiling which is desirable for aesthetic purposes or perhaps for location of individual bottles within the crate. The mold tools may therefore be correspondingly simple.

Although the reinforcement may be encapsulated in the plastic material in any appropriate manner, it is presently envisaged that an encapsulation injection molding technique will be used, in which the reinforcement armature is supported in a mold cavity spaced from the surfaces of the mold cavity whilst thermoplastics material is injected into the cavity around the armature. The support may be provided by pins which are retractable into the mold surfaces as the injection proceeds.

One example of a crate constructed in accordance with the present invention will now be described with reference to the accompanying drawings in which.

Figure 1:
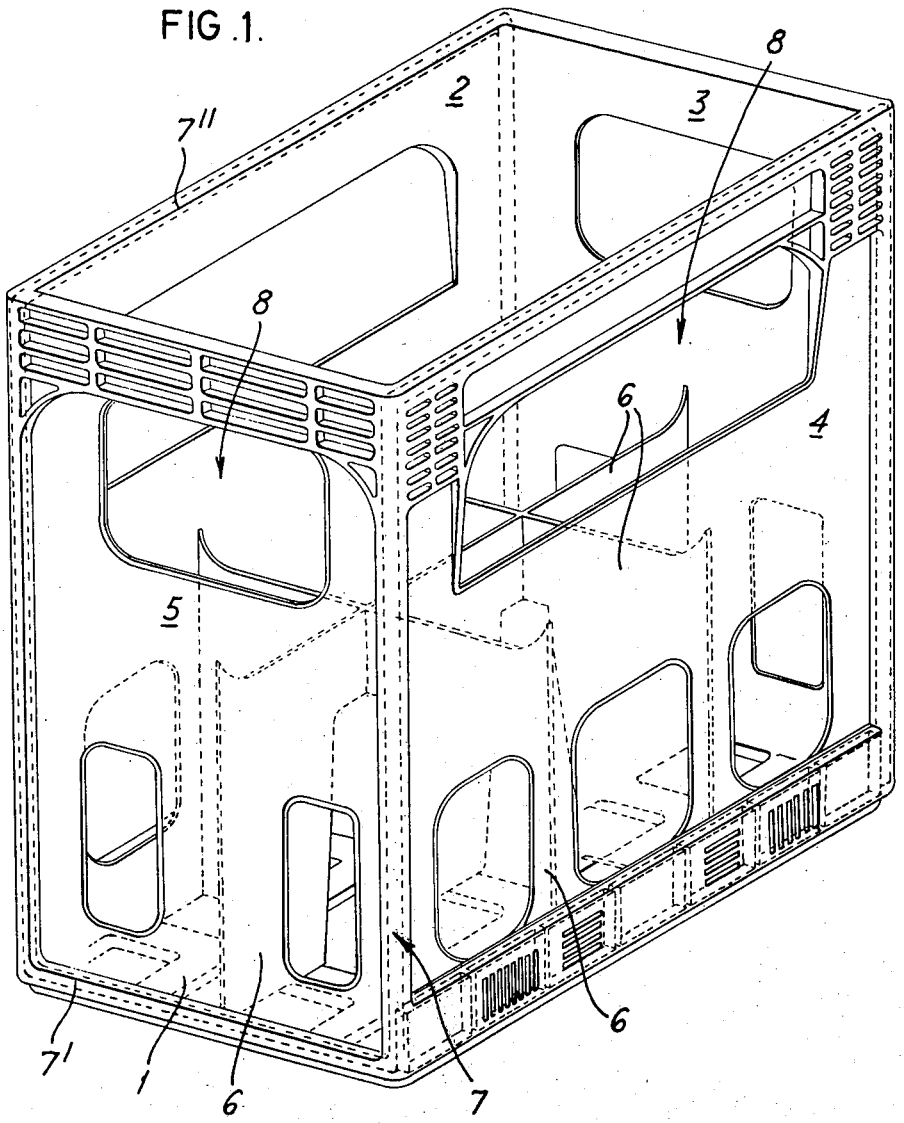
FIG. 1 is a partially broken away, perspective view of the crate.
Figure 2:
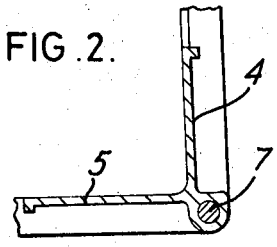
FIG. 2 is a cross-section through one corner edge of the crate.

As can be seen from FIG. 1, the crate comprises a bottom 1, side walls 2, 3, 4 and 5 and has an open top. The crate is intended for carrying bottles and thus includes a number of partitioning walls 6.

The crate is formed by an injection molding process from a thermoplastic material forming the base, walls and partitions, and includes a reinforcement armature 7 of steel. This particular crate is also rectangular and the side walls 2 and 4 nominally form rear and front faces respectively whilst the side walls 3 and 5 form end walls.

All four walls of the crate are simply web-like in structure and the structural strength of the crate is provided almost totally by the reinforcement armature 7. In this case the reinforcement extends along the top of the crate at the uppermost edges of the front and rear walls, 4 and 2 respectively, and along the lowermost edges of the two end walls 3 and 5.

When bottles are stacked in the crate and the crate is turned on its front or rear face, 4 and 2 respectively, so that the crates can be stacked in a stack with bottles from every crate being accessible, by far the greater portion of the weight is taken by the rear of the crate (in normal use the bottom face 1). In order to reinforce the crates in the vertical direction therefore the reinforcement armature 7 includes elements 7′ at the bottom of the end walls 5 and 3, which thus extend substantially vertically when the crate is tipped on to its front or rear face.

Handle openings 8 may be provided in all four walls 2, 3, 4 and 5 near their top edges. The reinforcement elements 7″ extending along the top edges of the front and rear walls therefore serve to strengthen the handle openings 8 in those walls.

Of course, it is equally possible for the reinforcement armature to be arranged so that the upper reinforcing elements extend along the top of the end walls of a crate and the lower reinforcing elements extend along the bottom edges of the front and rear walls. The upper elements extending along the top of the end walls thus serve to support and hold open the front of a crate when a number of crates are stacked on their front faces. Depending upon the particular use of the crate it may be more important to reinforce the front of the crate when it is stacked on its side, or the rear as in the case when the crate is intended for use with bottles.

I claim:

1. An open-topped rectangular crate formed of a synthetic plastic material comprising; a substantially rigid crate having two opposing side walls and two opposing end walls and a bottom and edges being formed where the walls and bottom meet, a continuous single length of reinforcement internally positioned in the walls of the crate, the reinforcement being in the shape of a deformed continuous loop and extending substantially along the upper horizontal edges of two opposing walls of the crate, down adjacent to and along the four vertical corner edges of the crate and along the bottom horizontal edge of the other two opposing walls of the crate to provide the sole reinforcement for the crate to facilitate reinforcement for the crate if stacked in vertical position or on its side.

2. A crate according to claim 1, wherein said reinforcement extends substantially along the upper edges of a front and rear wall of said crate, and along the bottom edges of two smaller end walls of said crate.

3. A crate according to claim 1, wherein said reinforcement extends substantially along the upper edges of two end walls of said crate and along the bottom edges of larger front end rear walls of said crate.

* * * * *